US006802495B1

(12) United States Patent
Schmidt

(10) Patent No.: US 6,802,495 B1
(45) Date of Patent: Oct. 12, 2004

(54) PULL THROUGH CLIP FOR WIRE FENCES

(76) Inventor: Roland F. Schmidt, 3139 11th Ave. North, Voltaire, ND (US) 58792

( * ) Notice: Subject to any disclaimer, the term of this patent is extended or adjusted under 35 U.S.C. 154(b) by 0 days.

(21) Appl. No.: 10/139,039

(22) Filed: May 3, 2002

(51) Int. Cl.[7] ..... E04H 17/02

(52) U.S. Cl. ..... 256/57; 256/2; 256/32; 256/47; 256/54

(58) Field of Search ..... 256/2–9, 32, 42, 256/47, 54, DIG. 3, 57

(56) References Cited

U.S. PATENT DOCUMENTS

| | | | | | |
|---|---|---|---|---|---|
| 340,311 | A | * | 4/1886 | Hayden | 256/54 |
| 368,459 | A | * | 8/1887 | Clow | 256/DIG. 3 |
| 962,523 | A | * | 6/1910 | Perry | 256/57 |
| 1,214,749 | A | | 2/1917 | Bruflat | |
| 1,814,228 | A | | 7/1931 | Peters | |
| 1,868,557 | A | | 7/1932 | Williams | |
| 2,631,804 | A | | 3/1953 | Uhlhorn | |
| 3,977,653 | A | | 8/1976 | Fingerson et al. | |
| 4,688,769 | A | | 8/1987 | Smrt | |
| 4,893,788 | A | | 1/1990 | Chave | |
| 4,982,932 | A | | 1/1991 | Baker | |
| 5,593,142 | A | | 1/1997 | Gerhart | |
| 6,050,549 | A | | 4/2000 | Foy | |
| 6,293,521 | B1 | | 9/2001 | Parrish | |
| 2001/0040235 | A1 | * | 11/2001 | Dwyer et al. | 256/47 |

* cited by examiner

*Primary Examiner*—Gregory J. Binda
*Assistant Examiner*—Victor MacArthur
(74) *Attorney, Agent, or Firm*—Curtis V. Harr

(57) ABSTRACT

A pull through fence clip is provided which is made of a single length of rod that is bent or shaped to form a device having an axis composed of two pins located at either end and a centrally located square-shaped body. The pull through fence clip is attached to a fence post by use of a commonly available post staple clip. The use of the present invention securely attaches a section of fencing wire to a fence post while allowing the individual fence wire to freely move along the line described by its longitudinal axis. The importance of this design is that it allows the fence to flex and compensate for changing conditions without impacting the general integrity and aesthetic quality of the fence as a whole.

11 Claims, 3 Drawing Sheets

FIG 1
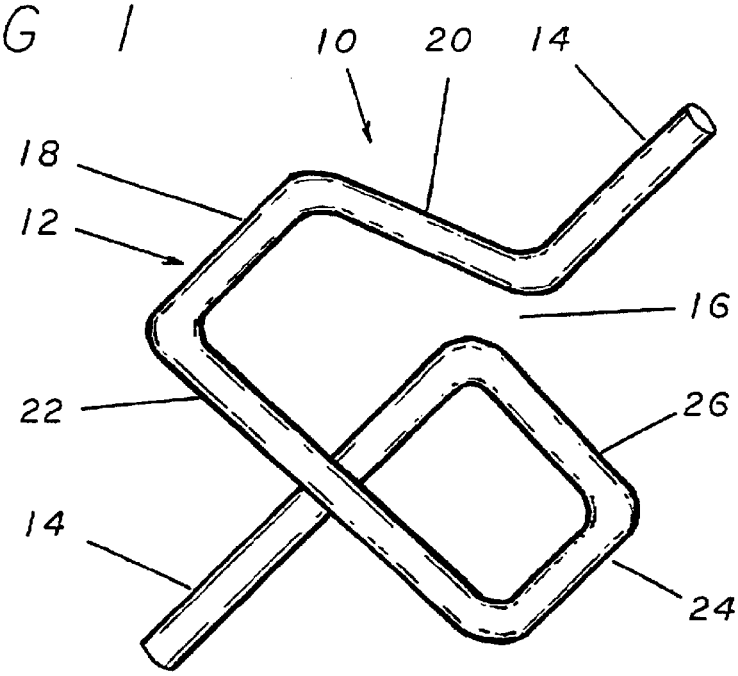
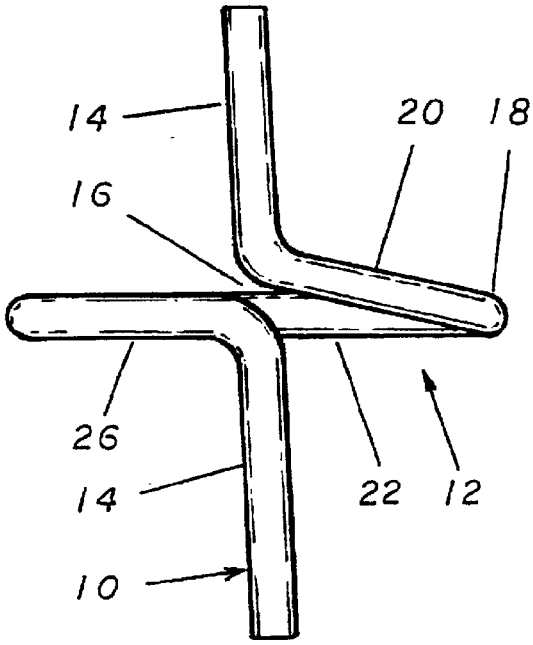
FIG 2
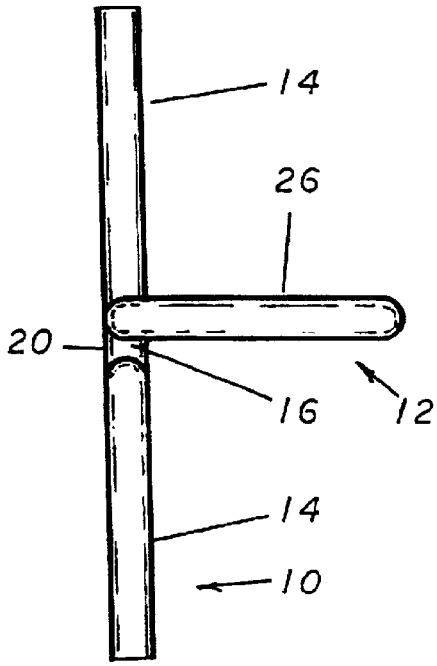
FIG 3

FIG 4
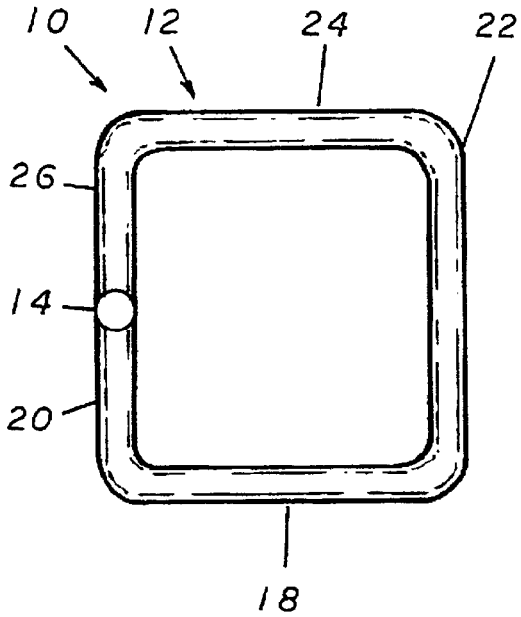
FIG 5
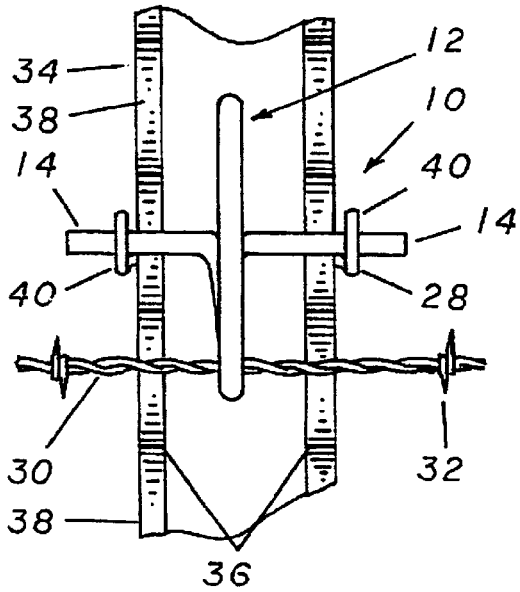
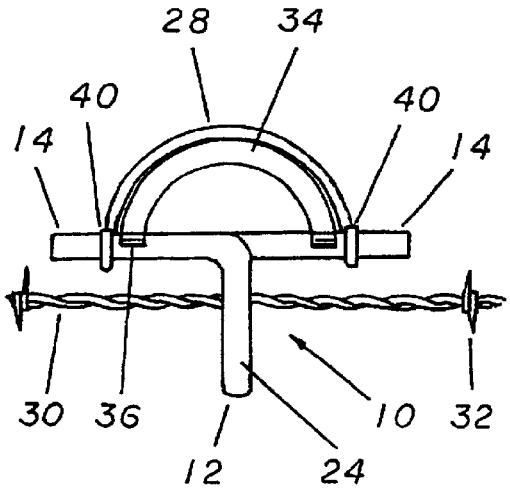
FIG 6
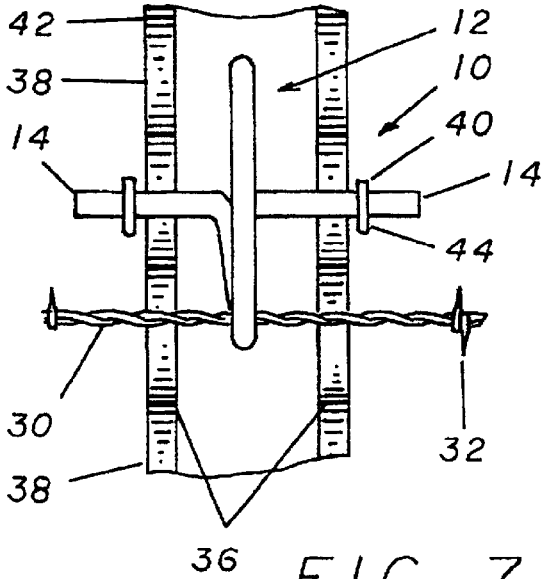
FIG 7

FIG 8
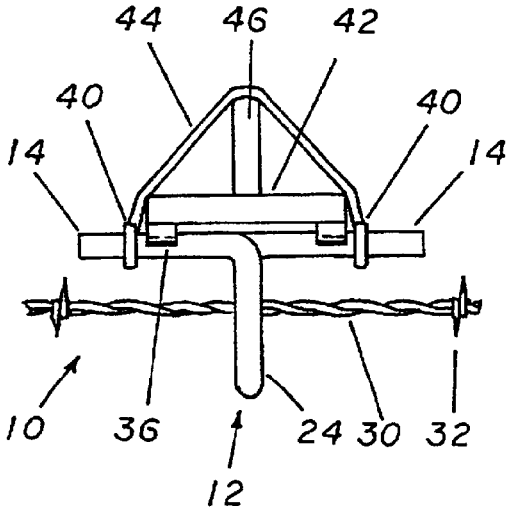
FIG 9
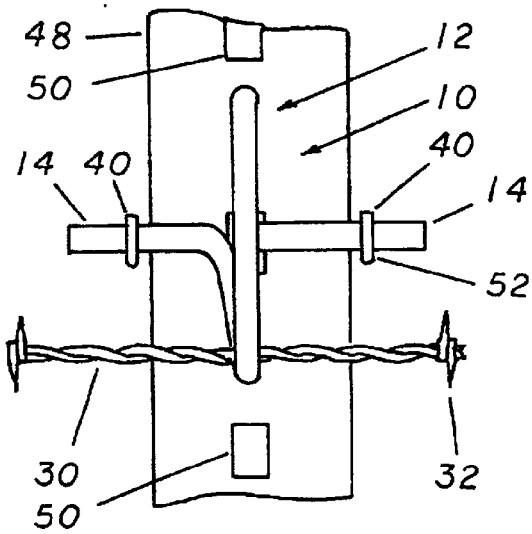
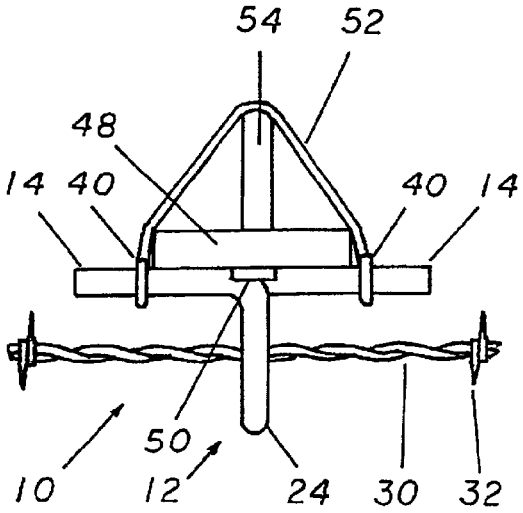
FIG 10

PULL THROUGH CLIP FOR WIRE FENCES

BACKGROUND OF THE INVENTION

The present invention relates to an improvement in the methods used to attach fence wires to the post that are used to suspend them in the desired locations. More specifically, to a fence clip device that securely attaches fence wire to the fence post while allowing it to freely move in a lateral manner. This freedom of lateral movement provides a mechanism which allows the fence to compensate for external forces that distort the fence wire by allowing the individual fence wire to laterally change their position relative to their point of attachment to the individual fence posts. Additionally, the use of the pull through fence clip also allows large sections of fence wire to be tightened without having to disconnect each wire from its point of attachment to each fence post.

The Prior Art illustrates a number of examples of fence wire attachment devices which are intended to secure a section of fence wire to a fence post while allowing it to move in a lateral manner. However, each of these devices contain flaws that limit their effectiveness in their designed function. The first of these is illustrated in U.S. Pat. No. 6,050,549 issued to Foy which describes a pull through fence wire clip that employs two C-shaped wire extensions that engage and wrap around a fence post to secure the clip to the fence post. This method of attachment is laborious and often results in attachments that are less than secure because it is not specifically design to be used on the variety of fence posts in common use today. Additionally, the design of this fence wire clip allows the fence wire to come into contact with the relatively large face of the fence post which can result a large amount of drag being created over the length of the wire and also increases the potential for snags developing at this point of contact.

In U.S. Pat. No. 5,593,142 issued to Gerhart, a fence wire clip is illustrated that employs a cylindrical tube to secure a strand of wire to a fence post. This device also employs a similarly awkward method of attaching it to a fence post which provides a less than secure method of fixing the clip to the post. Additionally, the use of the tube to secure the fence wire in the desired location subjects the wire to the difficulties of drag and the potential for snags as described above. These design problems limit the effectiveness of the pull through fence clip by restricting the lateral movement of the fence wire at its point of attachment to the fence post.

In U.S. Pat. No. 4,982,932 issued to Baker, a pull through fence clip is illustrated which is designed to attach fence wire to both metallic or wooden fence posts. The difficulty with this design is that the area the fence wire pulls through the clip is very small which again limits the lateral movement of the fence wire contained within it. Additionally, this fence clip is designed in such a manner that it requires the user bend relatively large metallic tabs around the fence post when attaching it to metal fence posts. This design feature makes the attachment of the clip to the fence post a difficult process which can in turn lead to problems in its performance over the life of the fence.

In U.S. Pat. No. 4,893,788 issued to Chave, a pull through fence clip is illustrated that employs a circular retainer that is attached to a fence post by the use of two long members that wrap around the rear of a fence post. This method of clip attachment again creates difficulties as it is not specifically designed to be used in conjunction with the variety of fence posts commonly in use today resulting in a less than secure fixing of the clip on the fence post.

From the foregoing discussion it can be seen that it would be desirable to provide a method of securing fence wire to fence posts allowing for the free lateral movement of the fence wire relative to the fence post. This lateral movement allows the fence to compensate for external forces placed on the fence, such as snow loads and contact with animals and farm implements, without requiring any direct action by the fence owner. Additionally, it can be seen that it would be desirable to provide such a method of attaching fencing wire to fence posts which employs commonly used clip attachment methods that are designed specifically for the different types of fence posts commonly in use today. This flexibility in the means used to attach the clip to the fence posts ensures that such attachments are secure and will enhance the performance of the fence over the course of its life.

SUMMARY OF THE INVENTION

It is the primary objective of the present invention to provide a method by which a fence wire, either barbed or otherwise, can be attached securely to the metallic type of fence post most commonly found in agricultural fencing today and which can be installed easily on existing fences without modifications to either the posts or fencing.

It is an additional objective of the present invention to provide such a method of attaching wire to a fence post in a manner that will allow a farmer or rancher to tighten a fence wire along a considerable length of fencing without having to free each wire from its attachment to each individual fence post in the desired length of fence.

It is a further objective of the present invention to provide such a method of attaching wire to a fence post in a manner that will provide a mechanism by which a length of fencing can absorb relatively large external forces, such as those created through contact with large grazing animals, farm implements, and snow banks, without placing undue forces on either the wire or the fence posts which can result in the breaking or distortion of the fence itself.

It is a still further objective of the present invention to employ such a method of attaching wire to a fence post in a manner that can be easily accomplished in an inexpensive fashion and which will be durable enough to last for the foreseeable life of the fence.

These objectives are accomplished by the use of a pull through fence clip that is made of a single length of metallic rod or other suitable material that is bent or shaped to form a device having an axis composed of two pins located at either end and a centrally located body. The pull through fence clip is then attached to a fence post by use of a commonly available post staple clip. The post staple clip is generally made up of a relatively short piece of wire that is bent around the back of the fence post with two hooks on its ends that extend slightly beyond the forward surface of the fence post.

In the case of the present invention, the hooks of the post staple clip are used to engage and hold the pins of the invention which in turn positions its central body in the proper location to engage and hold the desired section of fence wire. The central body essentially forms a two dimensional box that, while enclosing the central area, also leaves an opening through which a section of fence wire can be pulled through to gain access to the internal area of the body. This provides a mechanism by which a user can place a section of wire within the body of the invention which in turn will hold that wire in the desired location with reference to a specific fence post and a specific section of fencing.

The use of the two dimensional box formed by the invention's body to position the fence wire is pivotal to the operation of the present invention. This is due to the fact that the body simply provides a confined area in which the fence wire rests on its lower member which restricts its movement in all axises except longitudinally along the line defined by the fence itself. That is to say, the use of the present invention securely attaches a section of fencing wire to a fence post while allowing the individual fence wire to freely move along the line described by its longitudinal axis. The importance of this design feature of the present invention is that it allows the fence to flex and compensate for changing conditions without impacting the general integrity of the fence as a whole.

Wire fences are always subject to a variety of stresses that can have a negative impact on both their structural integrity and aesthetic qualities. These factors generally include such things as large animals leaning against or walking into the fence wire, farm implements such as tractors being inadvertently driven into the fence wire, subtle changes in the land due to weather and geologic activity, and snow drifts accumulating on the central areas of the fence wire span. The use of the present invention can alleviate some or all of the consequences of these forces by allowing the individual sections of the fence wire to pull freely through the body allowing the forces being generated in these circumstances to be distributed over a large section of fencing instead of being focused on the specific section of fence upon which the forces are acting. Therefore, the fence is much more likely to be able to flex and adapt instead of deforming or breaking at the point of localized stress.

Additionally, the design of the present invention also provides the benefit of allowing the individual fence wires to be tightened over large sections of fencing without the need to disconnect each wire from its individual attachment to every post over that section of fencing. Over the life of any wire fence there are forces which act upon it that tend to change the relationship between the wire and the fence post. The use of the present invention as a method of securing fencing wire to fence posts allows adjustments to be made to the fence in a much more efficient manner than was previously available as it allows a relatively large section of wire to be manipulated without having to disconnect it from the posts.

For a better understanding of the present invention reference should be made to the drawings and the description in which there are illustrated and described preferred embodiments of the present invention.

DESCRIPTION OF THE DRAWINGS

FIG. 1 is a perspective view of the present invention which illustrates the manner in which a single section of metallic rod can be manipulated to form the components comprising the invention.

FIG. 2 is a rear elevation view of the present invention illustrating the orientation of the positioning pins in relation to the body and the position of the body gap that allows for the insertion of a section of fence wire into the central body of the invention.

FIG. 3 is a top elevation view of the present invention illustrating the orientation of the positioning pins in relation to the body.

FIG. 4 is a side elevation view of the present invention illustrating the orientation of the positioning pins in relation to the body.

FIG. 5 is a front elevation view of the present invention illustrating the manner in which it is attached to a U-type fence post and the orientation of a section of fence wire when it is engaged within the body of the invention.

FIG. 6 is a top elevation view of the present invention as installed on a U-type fence post illustrating the manner in which the post staple engages and holds the invention in the desired position on the post.

FIG. 7 is a front elevation view of the present invention illustrating the manner in which it is attached to a ripple T-post fence post and the orientation of a section of fence wire when it is engaged within the body of the invention.

FIG. 8 is side elevation view of the present invention as installed on a ripple T-post fence post illustrating the manner in which the post staple engages and holds the invention in the desired position on the post.

FIG. 9 is a front elevation view of the present invention illustrating the manner in which it is attached to a T-post fence post and the orientation of a section of fence wire when it is engaged within the body of the invention.

FIG. 10 is a top elevation view of the present invention as installed on a ripple T-post fence post illustrating the manner in which the post staple engages and holds the invention in the desired position on the post.

DESCRIPTION OF THE PREFERRED EMBODIMENT

Referring now to the drawings, and more specifically to FIGS. 1, 2, 3, and 4 which illustrate the general manner of construction of the pull through fence clip 10, the present invention is made entirely from a single section of a steel rod, or other similar material, which is manipulated to form the components of the invention. At this point it should be stated that other material such as plastic UHMW plastic or various metal or like materials may all be suitable.

The components of the present invention include the positioning pins 14 which are the protruding ends of the rod from which the invention was formed and which form its central axis. The positioning pins 14 contain the centrally located clip body 12 and are employed to position the clip body 12 in the desired location. Therefore, the positioning pins 14 are the components of the present invention that are used to attach it to a specific point in a location so that it will perform its desired function in the proper manner.

The clip body 12 essentially forms a two dimensional box that encloses an open central area while leaving body gap 16 that allows for the insertion of an object into the area defined by the clip body 12. The primary component of the clip body 12 is the wire carrying member 18 which functions to support and position the object that is contained by the clip body 12. The wire carrying member 18 forms the base of the clip body 12 when properly oriented and is supported on one side by the body diagonal member 20 and on the other by the body side member 22. The body diagonal member 20 is the component of the clip body 12 which connects it to one of the positioning pins 14 and also is oriented diagonally (with reference to the orientation of the remaining components of the clip body 12) in a manner that leaves the body gap 16 in the box of the clip body 12. Additionally, the angle created at this juncture diverts the clip body 12 off of the central axis created by the positioning pins 14. The result of this is that the plane of the clip body 12 is offset to ninety degrees to that of the positioning pins 14.

The body side member 22 extends at a right angle from the other end of the wire carrying member 18 and forms the front surface of the clip body 12 when the invention is properly deployed. At the end of the body side member 22, the body top member 24 extends at a ninety degree angle that is parallel to the orientation of the wire carrying member 18 located at the bottom of the clip body 12. The other end of the body top member 24 is attached to the connective member 26 which again extends at a ninety degree angle from this junction and is parallel in its orientation to the body side member 22. Finally, the other end of the connective member 26 forms a junction with the remaining positioning pin 14 at a complex angle that reestablishes the central axis of the positioning pins 14. Thus, the interaction of these individual components forms the two dimensional box of the clip body 12 that is used to contain an object that has been pulled through its body gap 16.

The manner in which the present invention is attached to a fence post for the purpose of securing a section of fence wire 30 to it is illustrated in the following FIGURES; it should be noted that the examples given are purely for illustrative purposes and do not represent all of the possible applications for the present invention. That being said, FIGS. 5 and 6 illustrate the manner in which the present invention is attached to a commonly used type of fence post known as a U-post 34. The U-post 34 is an elongated metallic bar-like object being formed in its cross section in the shape of a U. The leading edge of the U-post 34, or the face of the U, is then formed in a manner that results in a series of alternating post ridges 36 and post valleys 38. The post valleys 38 are the components of the U-post 34 which provide the point of attachment for the positioning pins 14 of the present invention. In this, the positioning pins 14 are placed within two parallel post valleys 38 located on either side of the U-post 34 where they are held in place by the use of the U-post staple 28.

The U-post staple 28 is most commonly a section of heavy gauge wire that is formed in such a manner so that it roughly mimics the shape of the rear surface of the U-post 34 and has a pair of positioning clip hooks 40. The positioning clip hooks are simply bends fashioned in each end of the U-post staple 28 in a manner that it allows them to grasp and hold the positioning pins 14 of the present invention. This configuration serves to hold the present invention within the post valleys 38 as described above which in turn allows for the securement of the fence wire 30 in the desired location. Additionally, the general configuration of the clip body 12 as described above allows the fence wire 30 to pull freely through it, including any fence barbs 32 that may be contained along its length, without affecting its position in regards to the remaining components of the fence. This nature of the design of the present invention is pivotal to its function as it provides a mechanism by which the fence wire 30 can flex without affecting the fence as a whole and a mechanism by which the individual fence wires 30 can be tightened without having to disconnect it from its attachment to each fence post in a specific section of fencing.

FIGS. 7 and 8 illustrate the manner in which the present invention is used in conjunction with another commonly used fence post known as a ripple T-post 42. In its manner of operation and construction the ripple T-post 42 is very similar to the U-post 34 in that its face is constructed with a series of post ridges and valleys, 36 and 38, which serve to provide a point of securement for the present invention. It differs however in that it's cross section forms a T-like configuration with the top surface of the T being the face of the ripple T-post 42 and having a ripple T-post spine 46 which extends perpendicularly from the top of the T and constitutes the body of the ripple T-post 42.

Again, much like the situation described above for the U-post 34 above, the present invention is attached to the ripple T-post 42 by the use of a ripple T-post staple 44 which is constructed from a single piece of heavy gauge wire in a manner that forms the two positioning clip hooks 40 at each end of the ripple T-post staple 44. The ripple T-post staple 44 is constructed to fit the back surface of the ripple T-post 42 and so provides a stable mechanism by which the present invention can be positioned to secure the fence wire 30 in the proper orientation with reference to the individual ripple T-post 42 specifically and to the remaining components of the fence as a whole.

Finally, FIGS. 9 and 10 illustrate the present invention as fitted to another commonly used type of fence post known as the T-post 48. The T-post 48 is very similar in its manner of construction to the ripple T-post 42 described above (having a T-post spline 54 forming the body of the T-post 48) except that instead of having the series of post ridges and valleys, 36 and 38, used to secure the present invention, it utilizes a plurality of T-post knobs 50. The T-post knobs 50 are relatively small protrusions in the face of the T-post 48 that provide a step upon which inner surface of the positioning pins 14 of the present invention can rest to enhance their attachment to the face of the T-post.

This attachment is accomplished by the use of a T-post staple 52 that is configured to fit the rear surface of the T-post 48 and is used to secure the present invention to the face of the T-post 48 in exactly the same manner as described above for the ripple T-post 42. Thus, the present invention is designed in such a manner as to allow its attachment to a variety of different fence posts while providing a means by which the contained fence wire 30 move laterally within the clip body 12. This allows the fence as a whole to flex under varying circumstances which in turn lengthens the life of the fence with less upkeep. Additionally, this movement also makes it easier to tighten stretches of fence as it does not require that each fence wire 30 be disconnected from their attachment to every fence post to accomplish the stretching procedure. Therefore, the use of the present invention alleviates the most common problems associated with wire fence construction and maintenance that farmers and ranchers face today.

Although the present invention has been described in considerable detail with reference to certain preferred versions thereof, other versions are possible, for example the various materials may be used and the shape may be modified. Therefore, the spirit and scope of the appended claims should not be limited to the description of the preferred versions contained herein.

What is claimed:

1. A pull through fence clip for fastening elongate wire strands to a fence post said pull through fence clip comprising:

a single elongate bar having a left end and a right end and a substantially rectangular clip body said bar formed such that said left end and said right end form a left and a right substantially straight positioning pin said positioning pins being substantially parallel and extending straight in opposite directions along the same axis;

a U shaped fencing staple fastening said pull through fence clip to said fence post;

said clip body of said elongate bar formed with a 360 degree cross sectional perimeter contained on a plane perpendicular to said left and right positioning pins so as to substantially enclose said clip body, said clip body beginning at said left positioning pin with a substantially right angle bend in said elongate bar and ending at said right positioning pin with a substantially right angle bend in said elongate bar and said left and right positioning pins extend beyond the sides of said fence posts so as to allow said U shaped fencing staple to attach to said left and right positioning pin; and a body gap defined by said elongate bar such that said pull through fence clip may be placed over a wire strand so as to position said clip body about said wire strand without feeding said wire strand through said clip body.

2. A pull through fence clip as in claim 1 wherein said fence clip is formed from a metallic material.

3. A pull through fence clip as in claim 1 wherein said fence clip is formed from a plastic material.

4. A pull through fence clip for fastening an elongate wire strands to a fence post said pull through fence clip comprising:

a single elongate bar having a left end and a right end and a clip body said bar formed such that said left end and said right end form a left and a right substantially straight positioning pin said positioning pins being substantially parallel in the same plane and extending straight in opposite directions along the same axis;

said clip body of said elongate bar formed with a 360 degree cross sectional perimeter contained on a plane perpendicular to said left and right positioning pins, said clip body beginning at said left positioning pin with a substantially right angle bend in said elongate bar and ending at said right positioning pin with a substantially right angle bend in said elongate bar;

a body gap defined by said elongate bar such that said pull through fence clip may be placed over a wire strand so as to position said clip body about said wire strand without feeding said wire strand through said clip body; and a U shaped fencing staple having a first positioning clip hook removable attached to said left positioning pin, a second positioning clip hook removably attached to said right positioning pin with said U shaped fencing staple passing around said fence post from said first to said second positioning clip hook.

5. A pull through fence clip as in claim 4 wherein said clip body is rectangular in shape.

6. A pull through fence clip as in claim 5 wherein said left and right positioning pins extend beyond the sides of said fence posts so as to allow said U shaped fencing staple to attach to said left and right positioning pin.

7. A pull through fence clip as in claim 6 wherein said fence clip is formed from a metallic material.

8. A pull through fence clip as in claim 6 wherein said fence clip is formed from a plastic material.

9. A method of attaching an elongate wire strand to a fence post such that said elongate wire strand may move freely along its length relative to said fence post, said method comprising the steps of:

supplying a pull through fence clip formed from a single elongate bar having a left end and a right end and a clip body said bar formed such that said left end and said right end form a left and a right substantially straight positioning pin said positioning pins being substantially parallel in the same plane and extending straight in opposite directions along the same axis, said clip body of said elongate bar formed with a 360 degree cross sectional perimeter contained on a plane perpendicular to said left and right positioning pins, said clip body beginning at said left positioning pin with a substantially right angle bend in said elongate bar and ending at said right positioning pin with a substantially right angle bend in said elongate bar, and a body gap defined by said elongate bar;

slipping said elongate wire strand through said body gap; and fastening said pull through fence clip to said fence post with a standard U shaped fencing staple, said U shaped fencing staple having a first positioning clip hook removable attached to said left positioning pin, a second positioning clip hook removably attached to said right positioning pin with said U shaped fencing staple passing around said fence post from said first to said second positioning clip hook.

10. A method of attaching an elongate wire strand to a fence post as in claim 9 wherein said fence clip is formed from a metallic material.

11. A method of attaching an elongate wire strand to a fence post as in claim 9 wherein said fence clip is formed from a plastic material.

* * * * *